US005813364A

United States Patent [19]

Harrison

[11] Patent Number: 5,813,364

[45] Date of Patent: Sep. 29, 1998

[54] AUTOMATIC PET DOOR HOUSING

[76] Inventor: Charles Harrison, 6001 Wrigley Way, Ft. Worth, Tex. 76133

[21] Appl. No.: 853,200

[22] Filed: May 9, 1997

[51] Int. Cl.[6] ..... E06B 5/00

[52] U.S. Cl. ..... 119/501; 49/25

[58] Field of Search ..... 119/51.02, 163, 119/484, 482, 501; 49/25, 31

[56] References Cited

U.S. PATENT DOCUMENTS

| | | | |
|---|---|---|---|
| 2,173,455 | 9/1939 | Roby | 49/25 |
| 4,216,743 | 8/1980 | Cohen | 119/19 |
| 4,322,913 | 4/1982 | Himmer | 49/168 |
| 4,399,771 | 8/1983 | Medley | 119/501 |
| 4,697,383 | 10/1987 | Hagiwara | 49/25 |
| 4,729,342 | 3/1988 | Loctin | 119/163 |
| 4,851,746 | 7/1989 | Milke | 318/467 |
| 5,072,544 | 12/1991 | Breck, Jr. | 49/264 |
| 5,177,900 | 1/1993 | Solowiej | 49/363 |
| 5,185,954 | 2/1993 | Waddle, Sr. | 49/168 |

*Primary Examiner*—Robert P. Swiatek
*Attorney, Agent, or Firm*—Goldstein & Canio

[57] ABSTRACT

An automatic pet door, enclosed within a housing, having a pet door located in between two sensors. The two sensors are positioned on arms that extending perpendicular to the housing. An infrared beam extends between the two sensors. When the beam is interrupted, a signal is sent to a motor located on top of the pet door. The motor is in constant connection with a power supply. A rack and pinion device works in conjunction with the motor. When a pet walks in between the two arms and the beam is broken, the motor causes the rack and pinion device to engage with teeth found on the top portion of the pet door, thus causing the door to open. Once the pet walks through the open door and the beam is once again continuous, the door closes.

3 Claims, 2 Drawing Sheets

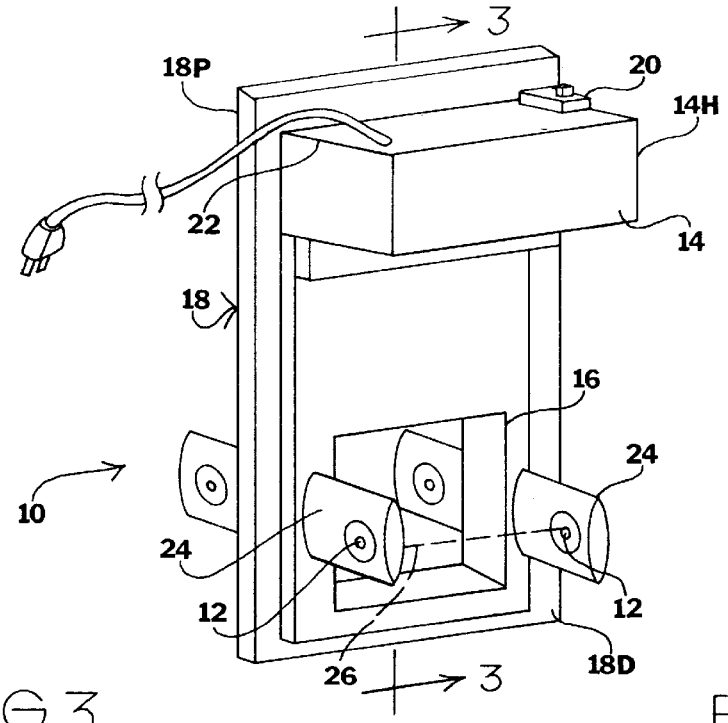
FIG. 2
FIG. 3
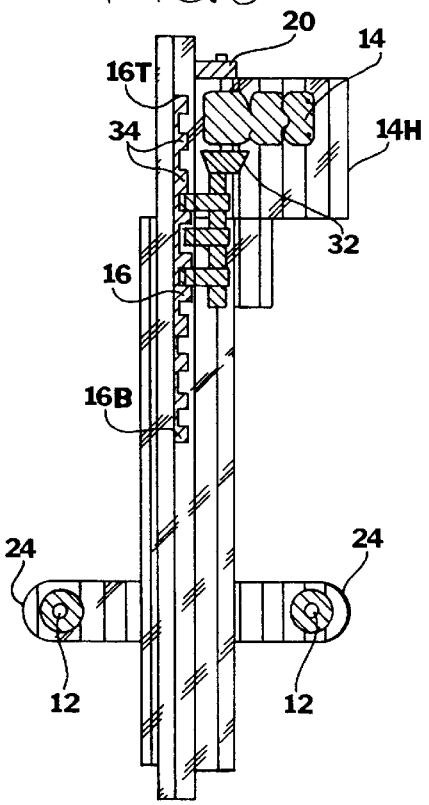
FIG. 4
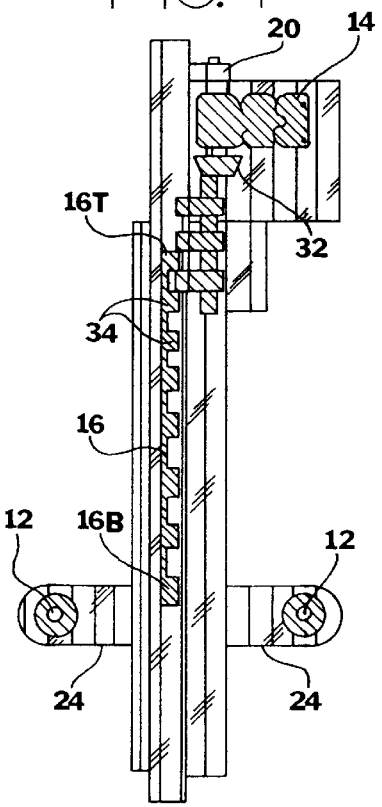

AUTOMATIC PET DOOR HOUSING

BACKGROUND OF THE INVENTION

The invention relates to an automatic pet door housing. More particularly, the invention relates to an automatic pet door housing that opens when a pet steps in front of the door, thereby breaking an infrared beam located between two sensors.

Many pet owners find it desirable to allow their pets to enter and exit the house at the pet's will and without assistance from a human. This is particularly the case when the pet is home alone for extended periods of time. Without human assistance, the pet is forced to remain in the house. Furthermore, since many pets frequently need to leave the home early in the morning, the sleeping pet owner is thereby disturbed and irritated.

In homes that have a sliding door leading to the backyard, many pet owners leave the door slightly ajar to allow the pet access to the home or yard. However, this solution is unfavorable since the home is left unprotected and subject to weather conditions.

Most pet doors comprise a hinged flap that swings open and closed when the pet pushes against it. Some pets, especially smaller ones, are reluctant to push against the door because of their size or lack of strength. Thus, doors of this nature are useless in homes with smaller pets. Moreover, these manual door can present a hazard to pets. The point between the hinged flap and the opening created in the wall or door may cause the flap and wall to jointly strike, thereby catching a paw or other extremity and causing injury to the pet. Besides harming the pet, the incident will often cause the pet to be reluctant to use the door again.

U.S. Pat. No. 5,185,954 to Waddle, Sr. discloses a pet portal device for use with a sliding door. While this device allows the pet free access to the yard or home, it can only be used in homes that have a sliding door. Another disadvantage to this device is that the pet has to push its way through the door. As explained above, this device would be ineffective in homes with smaller pets.

While these devices may be suitable for the particular purpose employed, or for general use, they would not be as suitable for the purposes of the present invention as disclosed hereafter.

SUMMARY OF THE INVENTION

It is an object of the invention to produce an automatic pet door housing that opens when a pet steps in front of the door, thereby breaking an infrared beam located between two sensors.

It is another object of the invention to produce an automatic pet door housing that allows the pet to enter or exit the home without any human assistance.

It is a further object of the invention to produce an automatic pet door housing that can be easily installed in any wall or door in the home.

It is a still further object of the invention to produce an automatic pet door housing that opens when the infrared beam is broken and closes within a preset amount of time.

The invention is an automatic pet door housing, enclosed within a housing, having a pet door located in between two sensors. The two sensors are positioned on arms that extending perpendicular to the housing. An infrared beam extends between the two sensors. When the beam is interrupted, a signal is sent to a motor located on top of the pet door. The motor is in constant connection with a power supply. A rack and pinion device works in conjunction with the motor. When a pet walks in between the two arms and the beam is broken, the motor causes the rack and pinion device to engage with teeth found on the top portion of the pet door, thus causing the door to open. Once the pet walks through the open door and the beam is once again continuous, the door closes.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a perspective view of the automatic pet door housing.

FIG. 3 is a cross-sectional view taken along the line 3—3 in FIG. 2, showing the door in the open position.

FIG. 4 is a cross-sectional view showing the door in the closed position.

DETAILED DESCRIPTION OF THE PREFERRED EMBODIMENTS

Figure 1:
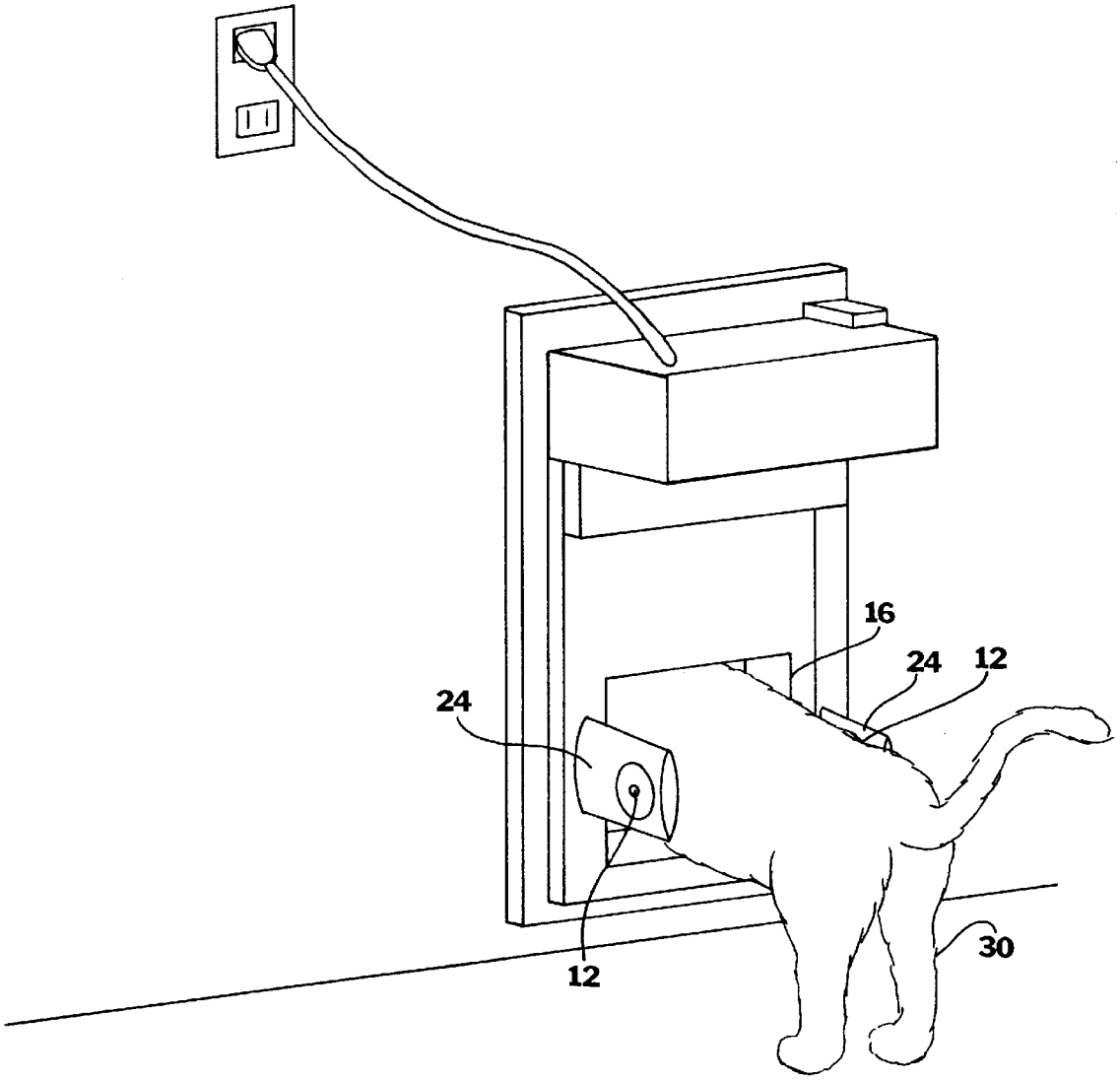
FIG. 1 is a perspective view of the automatic pet door shown with the door housing in the open position and a pet walking through the door.

FIG. 1, 2 and 3 illustrate an automatic pet door housing 10 comprising two sensors 12, a motor 14, a door 16 and a housing 18. The housing 18 has a proximal end 18P and a distal end 18D. Two arms 24 are located at opposite ends of the distal end 18D of the housing 18 and extend perpendicular from said housing 18. A sensor 12 is located in each arm 24 directly across from each other. A light beam 26 extends between the two sensors 12. The door 16 is located in between the two arms 24 and has a top portion 16T and a bottom portion 16B.

The motor 14 is enclosed in a motor housing 14H and is situated at the proximal end 18P of the housing 18, above the door 16 and sensors 12. A power supply 20 is located on a top edge 22 of the motor housing 14H. Said power supply 20 is in circuit with the motor 14, thus providing a constant power supply to the motor 14.

Referring to FIG. 1, when a pet 30 approaches the automatic pet door housing 10 and stands in between the two arms 24, the light beam 26 extending between the two sensors 12 is broken. The break in the beam 26 sends a signal to the motor 14, which causes the door 16 to automatically open.

Referring to FIG. 2 and 3, a worm gear 32 extends inside the housing 18 from the motor 14, and is driven by said motor 14. One side of the door 16 has teeth 34 extending along the top portion 16T of said door 16. The teeth 34 are enmeshed and mated with the worm gear 32. When the light beam 26 extending between the two sensors 12 is interrupted by a pet 30, a signal is sent to the motor 14 to rotate the worm gear 32, thus causing said door 16 to rise upward. Once the pet 30 passes through the open door 16 and the light beam 26 is once again continuous, the motor 14 disengages and the door 16 closes. FIG. 3 illustrates the door 16 in the raised position and FIG. 4 illustrates the door 16 in the closed position.

The bottom potion 16B of the door 16 is preferably composed of a clear, see-through material. The clear material enables the pet 30 to see what is on the opposite side of the door 16 and thus is more inviting for the pet 30 to pass through.

What is claimed is:

1. An automatic pet door housing, having a proximal end and a distal end, comprising:

a door, located at the distal end of the housing, having a top portion and a bottom portion;

two arms located at the distal end extending perpendicular to the housing, one arm located on either side of the door;

two sensors positioned at the distal end of the housing, one sensor on each arm located directly across from each other;

a motor, contained within a motor housing located at the proximal end of the housing;

a worm gear driven by the motor, enmeshed with teeth along the top portion of the door, that opens and closes the door; and a power supply that is in conjunction with the motor and supplies constant power to said motor.

2. The automatic pet door housing, as disclosed in claim 1, having a light beam extending between the two sensors, said beam being in conjunction with the motor.

3. A method of automatically opening a pet door, the pet door housing having a proximal end and a distal end, wherein a door, located at the proximal end and having a top and bottom portion, has a sensor located on an arm on either side of the door and a light beam, in conjunction with a motor located at the proximal end, extends between the two arms, and a worm gear that is driven the motor causes the door to open and close, comprising the steps of:

breaking a light beam extending between two sensors by positioning a pet in between two arms;

sending a signal to a motor once the light beam is broken which causes a worm gear to rotate, thus causing the door to rise upward; and cutting off the signal to the motor once the pet passes through the door and the light beam is once again continuous thereby causing the door to close.

* * * * *